US010677265B2

(12) United States Patent
Gebert et al.

(10) Patent No.: US 10,677,265 B2
(45) Date of Patent: Jun. 9, 2020

(54) SPIRAL HOUSING FOR A RADIAL FAN

(71) Applicant: ebm-papst Mulfingen GmbH & Co. KG, Mulfingen (DE)

(72) Inventors: Daniel Gebert, Öhringen (DE); Oliver Haaf, Kupferzell (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 130 days.

(21) Appl. No.: 15/579,606

(22) PCT Filed: Jul. 22, 2016

(86) PCT No.: PCT/EP2016/067507

§ 371 (c)(1),
(2) Date: Dec. 5, 2017

(87) PCT Pub. No.: WO2017/036668

PCT Pub. Date: Mar. 9, 2017

(65) Prior Publication Data

US 2018/0135653 A1 May 17, 2018

(30) Foreign Application Priority Data

Aug. 28, 2015 (DE) ..... 10 2015 114 389

(51) Int. Cl.
*F04D 29/66* (2006.01)
*F04D 29/42* (2006.01)
(Continued)

(52) U.S. Cl.
CPC ..... *F04D 29/663* (2013.01); *F04D 17/16* (2013.01); *F04D 25/08* (2013.01); *F04D 29/422* (2013.01);
(Continued)

(58) Field of Classification Search
CPC ..... F04D 29/663; F04D 29/4213; F04D 29/4226; F04D 29/422; F04D 29/666;
(Continued)

(56) References Cited

U.S. PATENT DOCUMENTS 7,972,110 B2 * 7/2011 Seki ..... F04D 29/4226 415/204
2007/0212218 A1 9/2007 Seki et al.
2015/0198178 A1 7/2015 Kawasaki

FOREIGN PATENT DOCUMENTS

DE 8308512 U1 1/1985
DE 19906537 A1 8/2000
(Continued)

OTHER PUBLICATIONS

International Search Report (in German with English Translation) for PCT/EP2016/067507, dated Oct. 26, 2016; ISA/EP.

*Primary Examiner* — David E Sosnowski
*Assistant Examiner* — Danielle M. Christensen
(74) *Attorney, Agent, or Firm* — Harness, Dickey & Pierce, P.L.C.

(57) ABSTRACT

A spiral housing of a radial fan has a flow cross-sectional area which, starting from a housing tongue, increases in the circumferential direction, around a fan impeller which can be arranged on an axial central axis. The cross-sectional area is determined via a contour of at least one axial side part of the spiral housing. The one axial side part has an axial suction opening with an opening edge section surrounding the suction opening, which is directly adjoined, viewed in the radial direction, by a transition section extending in the circumferential direction. The transition section, in a starting section which extends from the housing tongue in the circumferential direction over a predetermined angle, is spaced apart in the axial direction relative to the opening edge section and has a course which increases the flow cross
(Continued)

section in the circumferential direction until axial surfaces of the opening edge section and of the transition section extend in the same plane.

12 Claims, 2 Drawing Sheets

(51) Int. Cl.
*F04D 25/08* (2006.01)
*F04D 17/16* (2006.01)
*F04D 29/28* (2006.01)

(52) U.S. Cl.
CPC ..... *F04D 29/4213* (2013.01); *F04D 29/4226* (2013.01); *F04D 29/666* (2013.01); *F04D 29/281* (2013.01); *F05D 2250/51* (2013.01)

(58) Field of Classification Search
CPC ..... F04D 29/281; F04D 29/40; F04D 29/403; F04D 25/08; F04D 17/16; F05D 2250/51
See application file for complete search history.

(56) References Cited

FOREIGN PATENT DOCUMENTS

| | | | |
|---|---|---|---|
| DE | 10017808 | B4 | 4/2004 |
| DE | 102007010541 | A1 | 10/2007 |
| DE | 102009050684 | A1 | 4/2011 |
| EP | 1178215 | A2 | 2/2002 |

* cited by examiner

SPIRAL HOUSING FOR A RADIAL FAN

CROSS REFERENCE TO RELATED APPLICATIONS

This application is a U.S. National Phase Application under 35 U.S.C. 371 of International Application No. PCT/EP2016/067507 filed on Jul. 22, 2016 and published in German as WO 2017/036668 A1 on Mar. 9, 2017. This application claims priority to German Application No. 10 2015 114 389.5 filed on Aug. 28, 2015. The entire disclosures of all of the above applications are incorporated herein by reference.

FIELD

The disclosure relates to a spiral housing of a radial fan as well as to a radial fan with such a spiral housing.

BACKGROUND

Spiral housings in various forms are known from the prior art. The published documents DE 8308512 U1, DE 102009050684 A1 or DE 10017808 B4 disclose exemplary designs.

In radial fans, the function of the spiral housings is to collect the air flow at the outlet of the radial fan, allow it to flow in one direction and act as secondary guiding geometry. In the process, the conversion from dynamic pressure back to static pressure occurs. In the boundary area of the main spiral body and in the outlet, a spiral housing has a constriction which is referred to as housing tongue in professional circles. It is known that this housing tongue must be arranged close to the fan impeller in order to achieve a good efficiency of the radial fan. However, due to interaction of the rotating fan blades of the fan impeller with the housing tongue, this leads to strong tonal components in the noise spectrum of the fan (rotation-induced sound), which are perceived as disturbing and which increase the noise level considerably.

SUMMARY

Therefore, the underlying aim of the disclosure is to provide a spiral housing which has a good efficiency with reduced noise generation and low rotation-induced sound.

According to the disclosure, the aim is achieved by an adjustment of the housing contour, which has a direct effect on the flow cross section and consequently also on the flow responsible for efficiency and noise generation. Here, it is sufficient to adjust a side part of the spiral housing. The spiral housing is therefore preferably configured to have multiple parts, in particular two parts, a side part and a bottom part, which are separated substantially in the middle in the axial section.

Proposed is a spiral housing of a radial fan, with a flow cross-sectional surface area which, starting from a housing tongue, increases in the circumferential direction, around a fan impeller which can be arranged on an axial central axis, wherein the flow cross-sectional area is determined via a contour of at least one axial side part of the spiral housing. The side part has an axial suction opening with an opening edge section surrounding said suction opening, which is directly adjoined viewed in the radial direction by a transition section extending in the circumferential direction, which transition section, in a starting section which extends from the housing tongue in the circumferential direction over a predetermined angle, is spaced apart in the axial direction relative to the opening edge section and has a course which increases the flow cross section in the circumferential direction, until the axial surfaces of the opening edge section and of the transition section extend in the same plane.

The shape according to the disclosure is achieved in that, on the one hand, in the area of the housing tongue, a small axial spacing between fan impeller and spiral housing can be achieved, and, on the other hand, an increased axial spacing in the rest of the area of the spiral can be achieved. This increases the efficiency and reduces the rotation-induced sound of a radial fan using the spiral housing.

In an advantageous embodiment, it is provided that the transition section has the course which increases the flow cross section in the circumferential direction, until the axial surfaces of the opening edge section and of the transition section extend in the same plane. This means that, in the transition section, the axial surfaces of the opening edge section and of the transition section are oriented relative to the central axis perpendicularly to the central axis in each section.

Furthermore, in the spiral housing, it is advantageous if the axial surface of the opening edge section extends over the entire circumference perpendicularly to the rotation axis of the spiral housing. The transition section thus changes its contour compared to the opening edge section and increases the flow cross-sectional area along its extent in the circumferential direction. The opening edge section, on the other hand, extends over the entire circumference in an axial plane. This allows a relatively large axial installation height of the spiral housing in the suction area and in the area of the fan impeller.

In an advantageous development of the spiral housing, it is provided that a pressure space section forming at least in certain sections the pressure space of the spiral housing adjoins the transition section in the radial direction, wherein the flow cross-sectional area of the pressure space section in the starting section is determined by a contour which transitions tangentially in the radial section into the transition section. The pressure space section is the radially external area within the spiral housing in which the flow is conveyed substantially exclusively in the circumferential direction. The volume of the pressure space section within the spiral housing is considerably larger compared to the volume of the transition section. In the starting section, the transition section and the pressure space section transition continuously into one another due to the contour according to the disclosure viewed in the radial section.

In a design which is preferable with regard to efficiency and noise generation, the starting section extends, starting from the housing tongue, that is to say the narrowest place in the spiral housing, in the circumferential direction over an angle of 5-270°, more preferably over an angle of 20-180°. The above-described course of the transition section compared to the opening edge section or the pressure space section occurs preferably continuously over the entire angular range.

In a design variant of the disclosure, a middle section adjoins the starting section in the circumferential direction, middle section in which the axial surfaces of the opening edge section and of the transition section extend in the same plane perpendicularly to the rotation axis, and, as a result, the flow cross section formed by the transition section is constant. In other words, the transition section and the opening edge section coincide in the middle section and form a flat surface. Moreover, the pressure space section extends, adjoining the transition section, in the radial direction, with increased flow cross section compared to the transition section. Here, in the middle section, the flow cross-sectional area of the pressure space section increases sharply in the radial direction compared to the transition section.

The outlet geometry can directly adjoin the middle section in the circumferential direction. However, in an advantageous design of the spiral housing, an end section adjoins the middle section in the circumferential direction, in which the transition section forms an axial step which is directed inward in the axial direction and which decreases the flow cross section. As a result, the flow cross-sectional area which is increased in the starting section is reduced again in the end section. The outlet advantageously adjoins the end section directly.

In a design which also has an advantageous effect, the axial step is configured to be offset in the circumferential direction with respect to the housing tongue, so that the flow can be influenced independently of the housing tongue. However, in a special embodiment, the axial step has an extent in the circumferential direction with an orientation toward the housing tongue. Thus, the axial step accommodates the spiral shape without pointing directly into the outlet.

In an outlet section, the outlet adjoins the spiral shape in tangential direction, i.e., with a straight shape. Here, it is advantageous to form the axial step in the circumferential direction in the area of transition from the spiral shape into the straight shape of the outlet.

Furthermore, in the spiral housing according to the disclosure, it is advantageous with regard to good efficiency that the flow cross-sectional area increases continuously in the circumferential direction in the pressure space section.

In an advantageous development, it is provided moreover that, in the spiral housing, the suction opening is configured to be rotation symmetrical and as an inlet nozzle.

The disclosure also includes a radial fan with an above-described spiral housing.

DRAWINGS

Other advantageous developments of the disclosure are represented in greater detail below together with the description of the preferred design of the disclosure in reference to the figures.

FIGS. 1 and 2 show an embodiment of a spiral housing 1 of a radial fan according to the disclosure in different views.

DESCRIPTION

Figure 1:
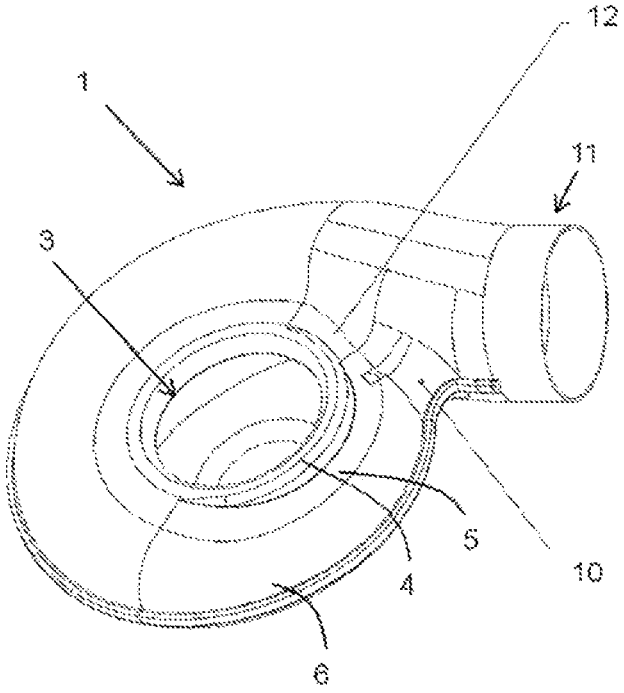
FIG. 1 shows a perspective representation of an embodiment of a spiral housing.
Figure 2:
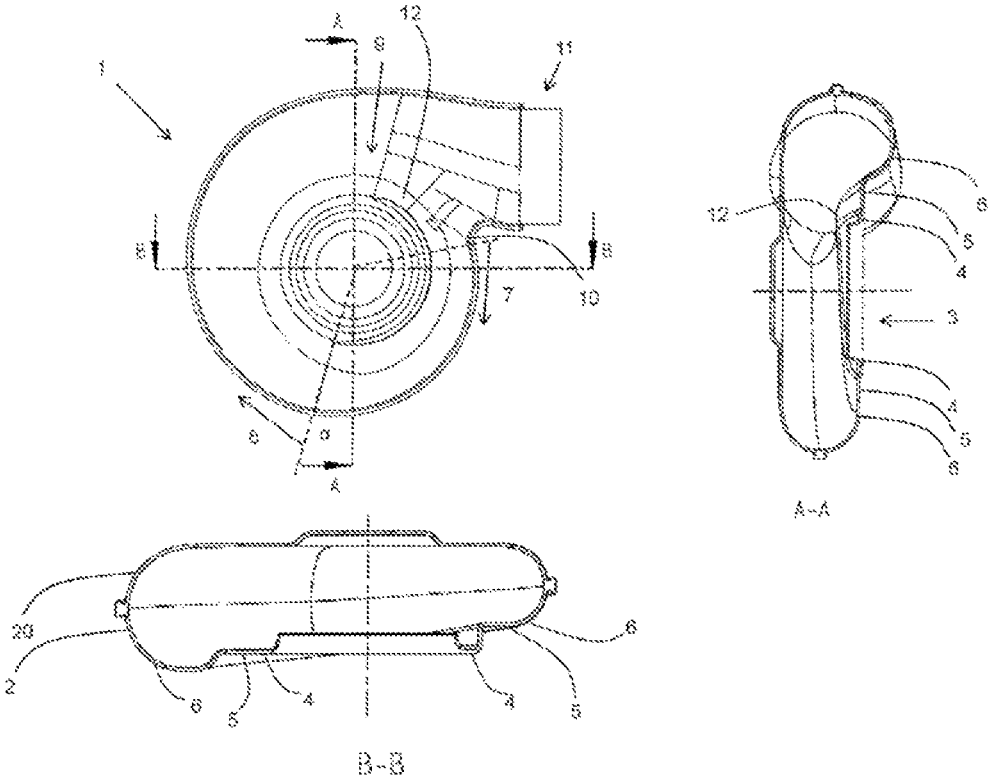
FIG. 2 shows a top view with cross-sectional views A-A and B-B of the spiral housing from FIG. 1.

The spiral housing 1 is formed in two parts with a side part 2 and a bottom part 20. The motor-driven fan impeller, not shown, is arranged on an axial central axis. The constriction, marked as housing tongue 10, in the circumferential direction (viewed in the flow direction), forms a starting point for an adjusted contour of different sections of the spiral housing 1, in order to increase the efficiency and to reduce the noise generation during operation. A tangentially extending outlet 11 adjoins the spiral shape of the spiral housing 1. The cross section of the outlet 11 can have any desired shapes and can be round, oval or elliptical, for example.

The side part 2 has an axial suction opening 3 with a circumferential opening edge section 4 forming an axial surface. The opening edge section 4 extends over its entire circumference perpendicularly to the rotation axis of the spiral housing 1. The suction opening 3 is formed as an inlet nozzle with a nozzle section extending conically into the suction opening 3, axially inward in the direction of the fan impeller.

The transition section 5 extending in the circumferential direction adjoins the opening edge section 4 directly viewed in the radial direction; said transition section is spaced apart in the axial direction from the opening edge section 4, in a starting section 7 extending from the housing tongue 10 in the circumferential direction over the angle $\alpha$ of more than 90°, and it has a course which broadens in the axial direction and by means of which the flow cross section in the transition section 5 is increased in the circumferential direction. This broadened course of the transition section 5 extends in the circumferential direction until the axial surfaces of the opening edge section 4 and of the transition section 5 extend in the same axial plane perpendicularly to the rotation axis of the spiral housing 1.

The pressure space section 6, which forms the pressure space of the spiral housing 1, adjoins the transition section 5 in the radial direction, the flow cross-sectional area of said pressure space section having a contour in the starting section 7 adjoining the housing tongue 10, which transitions tangentially in the radial cross section into the transition section 5, as can be seen clearly in the radial section B-B. The starting section 7 ends in the circumferential direction as soon as the transition section 5 and the opening edge section 4 have contours which transition tangentially into one another in the radial section, i.e., in this case, they extend in the same axial plane perpendicularly to the rotation axis of the spiral housing 1. This area forms the middle section 8 with constant flow cross section of the transition section 5.

Still viewed in the circumferential direction, the middle section 8 is followed by the end section 9, in which the transition section 5 forms an inward directed axial step 12 which decreases the flow cross section. The axial step 12 is a kind of second housing tongue configured to be offset in the circumferential direction with respect to the housing tongue 10 itself. The flow cross section, which at first increases in the circumferential direction and then is constant in the transition section 5, is again decreased by the axial step 12. The axial step 12 is formed in an area of transition of the spiral shape into the straight shape of the outlet 11, but it extends in the circumferential direction toward the housing tongue 10. Thus, the housing tongue 10 and the axial step 12 act together in terms of flow technology, although they are spaced apart in the circumferential direction.

A view of the spiral housing 1 in the radial direction shows that the flow cross-sectional area of the pressure space section 6 forming the pressure space increases sharply in the middle section 8 compared to the transition section 5. These increased dimensions are maintained up to the end section 9 and into the outlet 11. In addition, the flow cross-sectional area in the pressure space section 6 also continuously increases in the circumferential direction.

In addition to the axially recessed accommodation for the fan impeller, the bottom part 20 has a flat extent in the radial direction, without the special shaping of the side part 2.

The disclosure, in its design, is not limited to the above-described preferred embodiment examples. Instead, many variants which use the represented solution even in designs of fundamentally different type are conceivable. For example, the outer contour of the spiral housing, which does not influence the flow, can be of any shape.

The invention claimed is:

1. A spiral housing of a radial fan, the spiral housing comprising:

a flow cross-sectional area which, starting from a housing tongue, increases in a circumferential direction;

a fan impeller arranged on a central axial axis, wherein the flow cross-sectional area increases around the fan impeller in the circumferential direction and is determined via a contour of at least one axial side part of the spiral housing;

wherein the at least one axial side part has an axial suction opening with an opening edge section surrounding said axial suction opening which is directly adjoined, viewed in a radial direction, and a transition section extending in the circumferential direction;

the transition section, in a starting section extends from the housing tongue in the circumferential direction over a predetermined angle, the transition section is spaced apart in an axial direction relative to the opening edge section and the transition section has a course which increases the flow cross-sectional area in the circumferential direction, until axial surfaces of the opening edge section and of the transition section extend in the same plane, wherein a pressure space section, forming at least in certain sections a pressure space of the spiral housing, the pressure space section adjoins the transition section in the radial direction, wherein the flow cross-sectional area of the pressure space section is determined in the starting section by a contour which transitions in the radial section tangentially into the transition section; and a middle section adjoins the starting section in the circumferential direction, in the middle section, the axial surfaces of the opening edge section and of the transition section extend in the same plane perpendicularly to the central axial axis, and a flow cross section formed by the transition section is constant;

an end section adjoins the middle section in the circumferential direction, the end section and the transition section form an axial step that is directed in the axial direction inward and which decreases the flow cross section.

2. The spiral housing according to claim 1, wherein the transition section has the course which increases the flow cross-sectional area in the circumferential direction, until the axial surfaces of the opening edge section and of the transition section extend in the same plane perpendicularly to a rotation axis of the spiral housing.

3. The spiral housing according to claim 1, wherein the starting section extends in the circumferential direction over an angle of 5-270°.

4. The spiral housing according to claim 3, wherein the flow cross-sectional area in the pressure space section increases continuously in the circumferential direction.

5. The spiral housing according to claim 1, wherein the starting section extends in the circumferential direction over an angle of 20-180°.

6. The spiral housing according to claim 1, wherein an axial surface of the opening edge section extends over an entire circumference perpendicularly to the rotation axis of the spiral housing.

7. The spiral housing according to claim 1, wherein the axial step is configured to be offset in the circumferential direction relative to the housing tongue.

8. The spiral housing according to claim 1, wherein the axial step has an extent in the circumferential direction, which is directed at the housing tongue.

9. The spiral housing according to claim 1, wherein the spiral housing comprises a spiral shape with a tangentially extending straight outlet adjoining the spiral shape in an outlet section, wherein the axial step is formed in the circumferential direction in an area of transition of the spiral shape into the tangentially extending straight outlet.

10. The spiral housing according to claim 1, wherein, in the middle section, the flow cross-sectional area of the pressure space section increases sharply in a radial direction with respect to the transition section.

11. The spiral housing according to claim 1, wherein the suction opening is configured to be rotationally symmetric and as an inlet nozzle.

12. A radial fan with the spiral housing according to claim 1.

* * * * *